United States Patent [19]

Jacobson

[11] Patent Number: 4,953,873

[45] Date of Patent: Sep. 4, 1990

[54] METHOD OF AND MEANS FOR PLAYING A SPORTS GAME OF CHANCE

[76] Inventor: Michael R. Jacobson, 4-5-39 #105, Minami Azabu, Minato, Tokyo, Japan, 107

[21] Appl. No.: 342,166

[22] Filed: Apr. 24, 1989

[51] Int. Cl.[5] ..... A63F 3/00

[52] U.S. Cl. ..... 273/274; 273/94; 273/247

[58] Field of Search ..... 273/93 C, 93 R, 94, 273/274, 277

[56] References Cited

U.S. PATENT DOCUMENTS

| | | | |
|---|---|---|---|
| 3,667,757 | 6/1972 | Holmberg | 273/274 |
| 4,019,737 | 4/1977 | Witzel | 273/93 |
| 4,141,548 | 2/1979 | Everton | 273/94 |
| 4,706,959 | 11/1987 | Price | 273/274 |
| 4,722,526 | 2/1988 | Tovar et al. | 273/94 |

OTHER PUBLICATIONS

"Scarnes's New Complete Guide to Gambling" by John Scarne, pub. by Simon & Schuster, N.Y., copyright 1961, 1974; pp. 282 and 402.

*Primary Examiner*—William H. Grieb
*Assistant Examiner*—W. Pierce
*Attorney, Agent, or Firm*—Thomas N. Neiman

[57] ABSTRACT

The invention is of a method of and means for playing a sports game of chance comprising, according to the embodiment described, a playing board and a predetermined number of chips. The playing board, according to the described embodiment, lists the vast number of options possible during each play of a specific sporting event. The overall goal of each individual player consists of guessing the proper result of each play or sequence of plays prior to its occurrence, placing chips on the corresponding square, and winning the number of chips times the odds shown on that particular square, if that play or sequence does occur. The game continues until one player has won all the available chips. The novel steps include setting up the game board with particular occurences of a specific sport, along with the odds of each occurrence happening; appointing one player to be the banker of the chips; assigning a value to each color chip; passing out a predetermined number of each value chip to every player; having each player chips on a play square on the game board; directing the banker to pay off the proper number of chips to the correct player and collect the chips from the player's who did not guess correctly; and, continuing the game until one player has all the chips.

1 Claim, 2 Drawing Sheets

| Visitors score QTR | RUN Even | | Long Shot | | Pass Even | | Home score QTR |
|---|---|---|---|---|---|---|---|
| 0 | Lose Yardage | No Gain | Sack | Penalty next 4 Plays | Lose Yardage | No Gain | 0 |
| 1 | 6 to 1 | 5 to 1 | 15 to 1 | 20 to 1 | 10 to 1 | 6 to 1 | 1 |
| 2 | 1–2 yds | 3–4 yds | Blocked Punt | Missed Field Goal | Incomplete | 1–10 yds | 2 |
| 3 | even | even | 15–1 | Negotiate | 3 to 1 | even | 3 |
| 4 | 5–8 yds | 9–10 yds | Score This Play | TD This Play | 11–20 yds | 21–30 yds | 4 |
| 5 | 2 to 1 | 6 to 1 | Negotiate | Negotiate | even | 5 to 1 | 5 |
| 6 | 11–15 yds | 16–20 yds | TD next 4 Plays | Score next 4 Plays | 31 + yds | Interception | 6 |
| 7 | 10 to 1 | 15 to 1 | Negotiate | Negotiate | 10 to 1 | Negotiate | 7 |
| 8 | 21 + yds | Fumble next 4 Plays | Score This Drive | TD This Drive | Punt 40 yds + | Kickoff Return Past 20 | 8 |
| 9 | 20 to 1 | Negotiate | Negotiate | Negotiate | 8 to 1 | Negotiate | 9 |

FIG. 2

| Visitors score QTR | RUN Even | | Long Shot | | Pass Even | | Home score QTR |
|---|---|---|---|---|---|---|---|
| 0 | Lose Yardage | No Gain | Sack | Penalty next 4 Plays | Lose Yardage | No Gain | 0 |
| 1 | 6 to 1 | 5 to 1 | 15 to 1 | 20 to 1 | 10 to 1 | 6 to 1 | 1 |
| 2 | 1 – 2 yds | 3 – 4 yds | Blocked Punt | Missed Field Goal | Incomplete | 1 – 10 yds | 2 |
| 3 | even | even | 15 – 1 | Negotiate | 3 to 1 | even | 3 |
| 4 | 5 – 8 yds | 9 – 10 yds | Score This Play | TD This Play | 11 – 20 yds | 21 – 30 yds | 4 |
| 5 | 2 to 1 | 6 to 1 | Negotiate | Negotiate | even | 5 to 1 | 5 |
| 6 | 11 – 15 yds | 16 – 20 yds | TD next 4 Plays | Score next 4 Plays | 31 + yds | Interception | 6 |
| 7 | 10 to 1 | 15 to 1 | Negotiate | Negotiate | 10 to 1 | Negotiate | 7 |
| 8 | 21 + yds | Fumble next 4 Plays | Score This Drive | TD This Drive | Punt 40 yds + | Kickoff Return Past 20 | 8 |
| 9 | 20 to 1 | Negotiate | Negotiate | Negotiate | 8 to 1 | Negotiate | 9 |

METHOD OF AND MEANS FOR PLAYING A SPORTS GAME OF CHANCE

This invention pertains to methods of playing sports games of chance, and in particular the invention pertains to a method of and means for playing a sports game of chance, and the like comprising a game board and game chips. The element of chance comes to play by means of the luck required in guessing the result of a particular play, or sequence of plays, and anticipating the results by placing chips on the corresponding position on the board, and realizing the results by means of the odds that are noted on the game board.

It is the object of this game to provide a new sports game playing method which comprises an element of chance, is simple to play and can be played by two or more players as individuals. It is also an object of this game to be used in conjunction with broadcasts of sporting events to elevate the interest of the public in those sporting events.

Particularly, it is the object of this invention to teach a method of playing a sports game of chance comprising the steps of providing a game board displaying all the possible play outcomes for a particular sport and the odds of each play or sequence of plays occurring; providing a plurality of chips of varying value to each individual player; assigning to one player the responsibility of being the banker of said chips; having each player place chips on the square corresponding to the play or sequence of plays that they believe will occur; observing the play on the broadcast; having said banker pay out the proper number of chips based upon the number of chips bet times the odds shown on the game board; having the banker remove the chips on the game board for those guesses that did not occur; and continuing the game in the above-described manner until one player has won all the available chips. Additionally, it is the object of this invention to teach means for playing a sports game of chance, comprising a game board; said game board comprising lists of all the possible plays or sequence of plays of a particular sport in individual boxes; said game board further comprises a list of specific odds for some of said plays; said odds being negotiated for the other of said plays or sequence of plays; said game board further having point scoring positions for allowing guessing of said scores by defined time sections of said game; game chips; and said game chips having varying points assigned by the colors of said chips.

Further objects and features of this invention will become more apparent by reference to the following description taken in conjunction with the accompanying figures, in which:

FIG. 2 is a top view of the novel game board.

Figure 1:
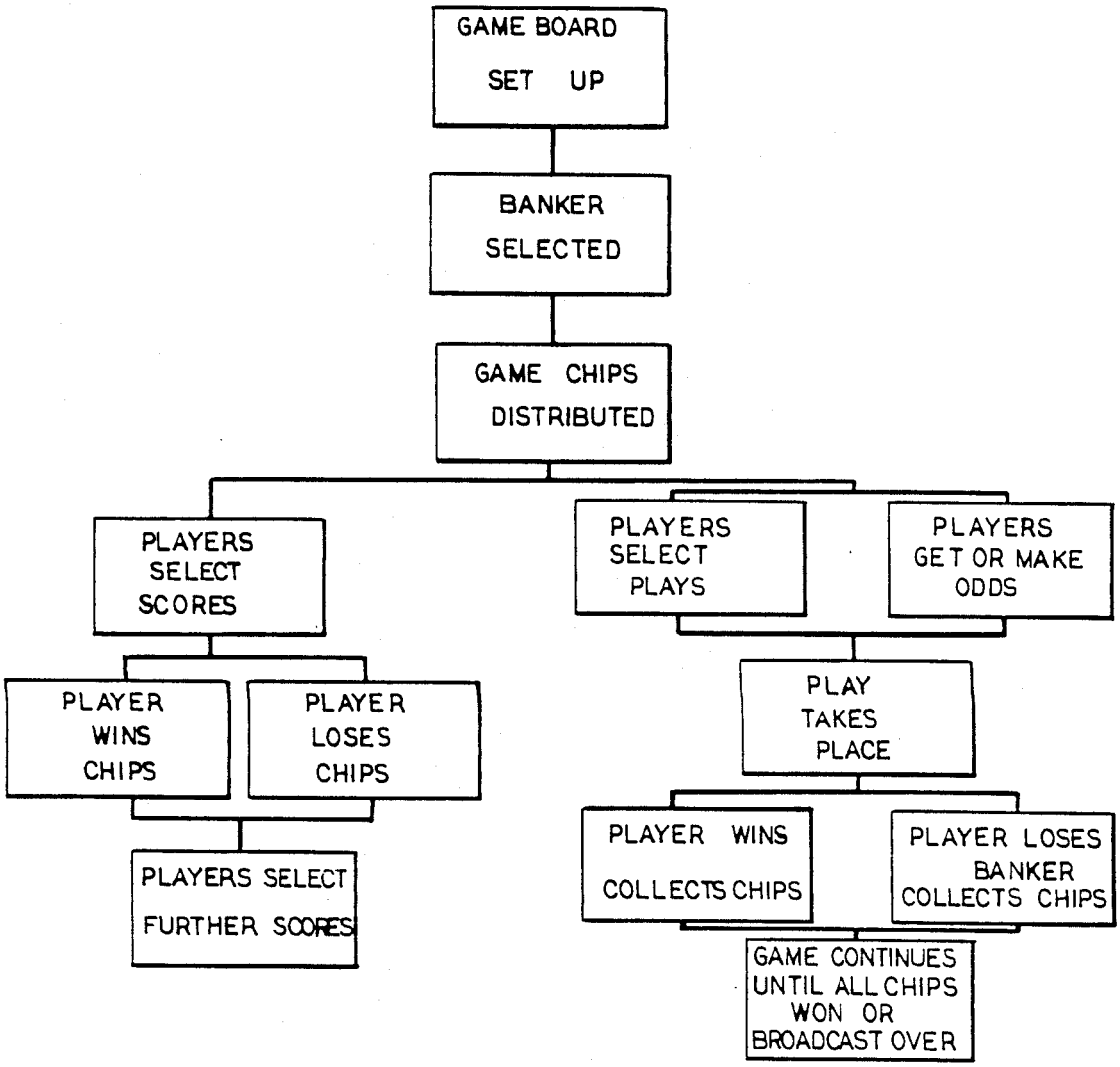
FIG. 1 is flow diagram describing the game playing process.

The object and overall goal of the game is to win all of the game chips available. The game materials comprise a game board and a plurality of game chips. The game board is designed for use with a particular game broadcast, as in the particular embodiment shown, football. All the possible play or sequence of play outcomes are listed under different categories in individual boxes. To play the game, the players appoint one individual player to act as the banker. The banker will then distribute the game chips to each individual player.

The game chips have the following value:

Blue chips equal 10 units
Red chips equal 5 units
White chips equal 1 units

The banker will distribute a total of ninety chips to each player—thirty chips of each color. Columns on the far left and right of the game board contain individual numbers from zero to nine. They represent the last digit of the visitors and home teams (respectively) scores at the end of each quarter of the game. The players will choose the score that the team will have. To win, the player must pick the exact number. Winner takes all the outer players bet chips. If no one has the winning number, the bets are cancelled and the chips are returned to the original player.

The game is a quickly moving affair, especially during the last two minutes of each half. The players place their chips on the play or sequence of plays that they believe will occur. On the boxes that allow negotiation of odds, the negotiations must be completed prior to the snap of the ball. The banker must accept all negotiated odds of three to one or less. He (the banker) does not have to accept any bet over those odds. The recommended maximum bet is ten units. All bets must be in place prior to the snap of the ball. The winning player is paid off by the banker at the rate of the individual's bet number of chips times the odds indicated on the game board or times the accepted negotiated odds. The player who acts as the banker can be changed at the end of each quarter. The game ends when the broadcast game is over or when one player has all the chips, whichever occurs first. In the case of the game ending, the winner is the player who has accumulated the largest number of game chips.

As one can readily see from the disclosed embodiment, the game is designed to include an element of chance to go along with knowledge of the game. It is also the purpose of the game to be simple to play, to be enjoyable and to give a player a choice of many possible plays to pick from. This enhances the game as far as giving the player some control over the chance aspect of the game. By taking teaching from my disclosure, those skilled in devising games of chance or the like, will appreciate that, in alternative embodiments, the sports game board can be prepared for other sports broadcasts, such as, baseball, basketball, hockey, etc. However, clearly, all such alterations and variations are wholly within the ambit of my invention.

While I have described my invention in connection with specific embodiments thereof, it is clearly to be understood that this is done only by way of example and not as a limitation to the scope of my invention as set forth in the objects thereof and in the appended claims.

I claim:

1. A method of playing a sports game of chance, comprising the steps of:

providing a game board displaying all the possible play outcomes for a particular sport and the odds of each said play or sequence of plays occurring;

providing a plurality of chips of varying value to each individual player;

assigning to one of said players the responsibility for the control of said chips, said controlling player to be known as the banker;

having each player place said chips on the position on said game board corresponding to said play or sequence of plays they believe will occur, said board position being referred to as a placement square;

observing said play on the broadcast of said sports game;

having said banker pay out the proper number of said chips based upon the number of said chips bet times said odds shown on said placement square of said game board;

having said banker remove said chips on the game board on said positions of said game board that did not occur during said play;

continuing said game in the above-described manner until one player has won all of said available chips;

allowing said game board display to have said odds on a number of said placement squares and allowing said certain other placement squares to have open negotiated odds; and permitting said negotiated odds to be accepted or rejected by said banker.

* * * * *